US010683721B2

(12) United States Patent
Cowie et al.

(10) Patent No.: US 10,683,721 B2
(45) Date of Patent: Jun. 16, 2020

(54) TEST TREE AND ACTUATOR

(71) Applicant: Interventek Subsea Engineering Limited, Aberdeen (GB)

(72) Inventors: Gavin David Cowie, Aberdeenshire (GB); John David Sangster, Aberdeen (GB)

(73) Assignee: Interventek Subsea Engineering Limited, Aberdeen (GB)

( * ) Notice: Subject to any disclaimer, the term of this patent is extended or adjusted under 35 U.S.C. 154(b) by 0 days.

(21) Appl. No.: 15/317,655

(22) PCT Filed: Jun. 23, 2015

(86) PCT No.: PCT/GB2015/051827

§ 371 (c)(1),
(2) Date: Dec. 9, 2016

(87) PCT Pub. No.: WO2016/001629

PCT Pub. Date: Jan. 7, 2016

(65) Prior Publication Data

US 2017/0122057 A1 May 4, 2017

(30) Foreign Application Priority Data

Jun. 30, 2014 (GB) ..... 1411639.6

(51) Int. Cl.
*E21B 33/06* (2006.01)
*E21B 29/04* (2006.01)
(Continued)

(52) U.S. Cl.
CPC ..... *E21B 33/0355* (2013.01); *E21B 34/045* (2013.01)

(58) Field of Classification Search
None
See application file for complete search history.

(56) References Cited

U.S. PATENT DOCUMENTS 3,137,214 A 6/1964 Feld et al.
3,229,590 A 1/1966 Huska
(Continued)

FOREIGN PATENT DOCUMENTS

CN 201627561 U 11/2010
WO WO-2011/041550 A2 4/2011
(Continued)

OTHER PUBLICATIONS

International Search Report PCT/ISA/210 for International Application No. PCT/GB2015/051827 dated Dec. 14, 2015.
(Continued)

*Primary Examiner* — James G Sayre
*Assistant Examiner* — Douglas S Wood
(74) *Attorney, Agent, or Firm* — Harness, Dickey & Pierce, P.L.C.

(57) ABSTRACT

A subsea test tree comprises a housing defining a flow path, a valve member mounted in the housing and an actuator coupled to the housing. A drive arrangement extends through a wall of the housing to operatively connect the actuator to the valve. The actuator is operable to operate the valve member to control fluid flow along the fluid pathway. Also disclosed are improvements to actuators.

16 Claims, 11 Drawing Sheets

(51) Int. Cl.

| | |
|---|---|
| ***E21B 29/08*** | (2006.01) |
| ***E21B 34/04*** | (2006.01) |
| ***E21B 33/035*** | (2006.01) |

(56) References Cited

U.S. PATENT DOCUMENTS

| | | | | |
|---|---|---|---|---|
| 3,680,982 | A | 8/1972 | Jacobellis | |
| 3,724,501 | A * | 4/1973 | Scott | E21B 17/01 137/630.19 |
| 3,731,599 | A | 5/1973 | Allen | |
| 3,839,945 | A | 10/1974 | Jacobellis | |
| 3,975,989 | A | 8/1976 | Hirmann | |
| 3,977,648 | A * | 8/1976 | Sigmon | F15B 15/103 251/59 |
| 4,375,239 | A | 3/1983 | Barrington et al. | |
| 4,513,823 | A * | 4/1985 | Hynes | E21B 34/04 166/316 |
| 4,751,869 | A | 6/1988 | Paynter | |
| 5,284,209 | A | 2/1994 | Godfrey | |
| 5,551,665 | A * | 9/1996 | Noack | E21B 29/04 166/324 |
| 5,758,800 | A | 6/1998 | D'Andrade | |
| 5,975,106 | A | 11/1999 | Morgan et al. | |
| 6,964,304 | B2 * | 11/2005 | Skeels | E21B 34/04 137/81.2 |
| 7,419,134 | B2 * | 9/2008 | Gruel | F16K 31/105 251/30.01 |
| 9,441,439 | B2 * | 9/2016 | Allensworth | E21B 29/04 |
| 2004/0118567 | A1 | 6/2004 | Skeels | |
| 2008/0110633 | A1 | 5/2008 | Trewhella | |
| 2008/0202761 | A1 | 8/2008 | Trewhella | |
| 2013/0092389 | A1 | 4/2013 | Du et al. | |
| 2013/0103208 | A1 | 4/2013 | Niemeyer et al. | |
| 2014/0174755 | A1 | 6/2014 | Mitchell et al. | |
| 2015/0369001 | A1 * | 12/2015 | Hoang | F16K 3/0254 166/250.01 |

FOREIGN PATENT DOCUMENTS

| | | | |
|---|---|---|---|
| WO | WO-2013/032987 | A1 | 3/2013 |
| WO | WO-2014/065995 | A1 | 5/2014 |
| WO | WO-2014/116577 | A1 | 7/2014 |

OTHER PUBLICATIONS

Written Opinion of the International Searching Authority PCT/ISA/237 for International Application No. PCT/GB2015/051827 dated Dec. 14, 2015.

Great Britain Search Report for Great Britain Application No. GB1411639.6 dated Dec. 10, 2014.

* cited by examiner

TEST TREE AND ACTUATOR

CROSS-REFERENCE TO RELATED APPLICATIONS

This application is the U.S. National Phase application of PCT Application No. PCT/GB2015/051827 filed on Jun. 23, 2015, which claims priority to Great Britain Application No. 1411639.6 filed on Jun. 30, 2014 the entire contents of each of which are incorporated herein by reference.

FIELD

The present invention relates to a Sub Sea Test Tree (SSTT) and to an actuator for use with an SSTT.

BACKGROUND

When performing certain procedures on oil and gas wells, such as during workover or intervention operations, running completions, clean-up, abandonment and the like, it is necessary for to apparatus to include valves capable of isolating the formation from surface.

In some instances where a marine riser is utilised to facilitate wellbore operations such as deploying completions or performing wellbore interventions, a so called landing string assembly is typically used, which extends inside the riser from surface to the wellhead, normally landed-out in a wellhead tubing hanger. This landing string may be used as a contained passage to permit fluids and/or equipment to be deployed from surface, and/or may be used to deploy wellbore equipment, such as completion strings, into the associated wellbore.

The landing string is typically includes an upper section composed primarily of tubing, and a lower section which includes various valves for providing well control. For example, landing strings typically include a valve assembly called a subsea test tree (SSTT).

The valves within a SSTT may need to provide the capability to both contain fluids under pressure and also cut obstructions, such as wireline, coiled tubing, tools strings, or the like which extend through the valves. A variety of different valves are used for this so-called "shear and seal" purpose, with the particular type selected dependent on variables such as the wellhead infrastructure and the nature of the wellbore operation.

In many instances landing strings need to be sized and arranged not only to be deployed through a marine riser, but also to be accommodated within wellhead equipment, such as within BOP stacks. For example, the SSTT is typically located within the confines of the BOP, such that the outer dimensions of the SSTT are limited. Also, the axial extent of the SSTT needs to be such that, normally, it must be positioned between individual BOP rams, thus placing axial length size restrictions.

Further, the industry is increasing the requirements for such valves. Notably, emerging specifications such as ISO 13628-7 and API 17G are demanding that the structural integrity of the SSTT, including its housing and associated valves be improved to provide increased fatigue performance. To meet these requirements, the typical arrangement of current valves and actuation hardware takes up an increasing amount of the available space. For in-riser applications, there can be very little room to provide the additional functionality demanded by the industry codes.

Numerous valve designs exist, such as ball valves, flapper valves, ram valves, and the like. Each valve design has associated advantages and disadvantages, and often the particular design selected is very much dependent on the required application.

Ram valves, such as might be used in BOPs, have good cutting and post cut sealing capabilities, but typically require large projecting actuators, which restricts their application, for example precluding the possibility of through riser deployment.

Ball valves can be diametrically compact, and thus permit use in through riser deployment applications. However, used in SSTTs normally have associated internal linear actuators, which requires increased axial length, which can limit their ability to be installed in certain BOP stacks. Also, such internal actuators typically utilise elastomer type seals, which can suffer in the high pressures and temperatures normally associated with wellbores.

The general principles of fluid actuators are described, for example at: http://hydraulicspneumatics.com/200/FPE/MotorsActuators/Article/False/6426/FPE-MotorsActuators. Rotary apparatus is also described in U.S. Pat. Nos. 3,839,945 and 3,680,982 (Jacobellis), 3,229,590 (Huska), 3,137,214 (Feld et al.), 3,977,648 (Sigmon), 3,731,599 (Allen) and 5,975,106 (Morgan et al.). However, such apparatuses are not adapted for use in an SSTT. In addition, inflatable bladders are also described in U.S. Pat. No. 3,975,989 (Hirman), in use in a linear lift apparatus, U.S. Pat. No. 4,751,869 (Paynter) in a tension actuator, and U.S. Pat. No. 5,758,800 (D'ANDRADE) in use to propel water. Industrial bladders are available from Aero Tec Laboratories Ltd of Milton Keynes, or Tompkins Industries Inc. of Olathe, Kans., for use in lift apparatus, motorsports and the like and which are not adapted for use in the oil and gas industry.

SUMMARY

According to a first aspect of the invention there is provided a subsea test tree, comprising:

a housing defining a flow path;

a valve member mounted in the housing;

an actuator coupled to the housing; and a drive arrangement extending through a wall of the housing to operatively connect the actuator to the valve;

the actuator operable to operate the valve member to control fluid flow along the fluid pathway.

The actuator may be isolated from a fluid environment within the housing.

The fluid environment within a well is typically at a high pressure environment and may also be at a high temperature, or include abrasive particles and/or corrosive chemicals. Accordingly, the invention provides for isolation of the actuator from the fluid environment inside the test tree housing and consequently improved the actuator service life and reliability. Conventionally, SSTT actuators are located within the housing, at least in part and are exposed to the fluid environment of the well. Not only does this arrangement reduce service life, but more robust materials and mechanisms may be required, which in turn may take up additional space than required for the present invention.

The flow path accommodates fluid flow into and out of the well and may enable tools, wireline, tubing, etc. to be run into the well.

The drive arrangement may comprise a drive structure, such as a drive shaft. The drive arrangement may comprise a linkage, such as a lever arm, a lead screw and carriage, or the like. The housing may be sealed around the drive arrangement, so as to isolate the actuator from the fluid environment within the housing. A suitable dynamic seal may be provided between the drive apparatus and the housing, such as a packing seal around a drive shaft.

The actuator may be secured (e.g. bolted, welded, riveted) to an outside of the housing.

The housing may comprise a recess. All or a part of the actuator may be accommodated within the recess.

One or more parts of the actuator may be defined by a wall of the housing. For example, one or more conduits, internal cavities, chambers or cylinders may be defined or defined in part by the housing.

One or more parts of the actuator contained within an actuator housing, and the actuator housing may be adapted to be secured to the test tree housing. The actuator housing may be adapted to fit (fully or partially) into a recess in the test tree housing.

The actuator may comprise an actuator outer casing. The actuator outer casing may lie flush with an outer surface of the housing. For example, the test tree may comprise a cylindrical housing and the actuator outer casing may define a part of a cylindrical surface having the same curvature as the housing.

The test tree is typically required to be accommodated within a constrained space such as a restricted diameter and axial length within a blow-out preventer (BOP). The invention may provide for more efficient use of the available space, and may allow for use of a larger diameter flow path and/or larger or more powerful valves than conventional apparatus.

Additionally, an actuator outer casing which is flush with the housing may provide for use of the largest possible housing which is compatible with such other apparatus with which the test tree is used, such as a rotating table, lubricator, or when the test tree is run into a tubular.

In the case of conventional SSTT apparatus, in which both the actuators and valves are located within the housing, the housing walls must be thinner and/or the flow-path restricted, in order for the housing to meet the required pressure rating. By locating the actuator on the housing or at least partly accommodated within the housing walls, the present invention may provide for additional housing wall thickness and/or a wider flow-path. This may facilitate conventional connections, such as flange connections, to be established with adjacent apparatus, such as a slick joint, latch or the like.

The test tree may comprise any suitable type of actuator.

The test tree may comprise a hydraulic actuator, a pneumatic actuator, a mechanical actuator, and/or an electromechanical actuator. The motive force by which the actuator is operated may be provided by a fluid pressure differential or a mechanical force, or a combination thereof.

The actuator may be a force-change actuator, configured to convert a first force into a second force having a different magnitude or vector. The actuator may convert a first type of energy into a second type of energy.

A change in the magnitude/vector of the second force from the first force may be achieved by way of a leverage, a gearing arrangement, differential surface areas and the like.

The actuator may be configured to convert potential energy into kinetic energy. Potential energy may for example arise from a fluid pressure differential, a voltage, and/or a mechanical tension or compression.

The actuator may be a linear actuator. The actuator may be configured to convert linear motion to rotational motion, for example by way of a coupling such as a lever arrangement, a sliding sleeve and pin arrangement or the like.

The actuator may be a rotary actuator. The actuator may be configured to transmit a rotational motion to the valve, e.g. via a drive structure such as a drive shaft. The actuator may be configured to convert a rotational motion to a linear motion.

The actuator may be operable to move between first and second configurations. The valve may for example be open in the first configuration and closed (so as to prevent fluid flow along the flow-path) in the second configuration.

The actuator may be selectively moveable between the first and second configurations. The actuator may be biased towards the first or the second configuration, for example by a resilient member such as a spring or resilient member.

In embodiments comprising a fluid actuator, the actuator may be operable using a working fluid or fluids. The actuator may be a pneumatic or a hydraulic actuator. The actuator may be configured to function using either a gaseous or liquid working fluid, according to operational requirements. For example, the actuator may be operable using a working liquid in one direction and using a working gas in another direction.

The fluid actuator may comprise an internal chamber and a piston moveable within the internal chamber. A piston chamber (e.g. a cylinder) may be defined by the walls of the internal chamber and the piston, such that the volume of the piston chamber varies with movement of the piston. A piston chamber may be defined to each side of the piston.

The piston may be movable between first and second positions. The first and second positions may correspond to the said first and second configurations of the actuator.

The piston may be slidably moveable within the internal chamber.

A fluid pressure differential, by which the fluid actuator is operated, may be applied from external apparatus connected to the actuator (e.g. at the surface), through one or more fluid conduits connected to the actuator. A fluid pressure differential may be applied by exposing a part of the actuator to an external fluid pressure, such as all or a part of the fluid pressure within the well. A fluid pressure differential may be applied by exposing a part of the actuator to the pressure of fluid within the well and another part of the actuator to the (typically lower) pressure of fluid at the sea bed.

Exposure to an external pressure or pressure differential may comprise exposure of a part of the actuator to an external fluid such as sea water or well fluids. Alternatively, the actuator may be isolated from external fluids. For example, an external fluid pressure may be transmitted to the actuator via one or more hydraulic or pneumatic lines.

The piston may be moveable (towards the first and/or the second position) responsive to a fluid pressure differential across the piston. The piston may be movable under the action of a working fluid within the cylinder.

A working fluid may for example be a gas, or a liquid such as water, brine, oil, a glycerol or silicone based hydraulic fluid, a wellbore fluid or the like. The working fluid may be a high pressure fluid, at a pressure of between around 100-1,000 psi (e.g. around 500 psi) or in some cases at a pressure of above 1000 psi, say between around 6,000-10,000 psi (e.g. around 8,000 psi). The SI unit of pressure, the Pa, corresponds to around $1.45\times10^{-4}$ psi and thus 1,000 psi is approximately 7 kPa.

The actuator may comprise a fluid control arrangement for regulating and controlling the flow of working fluid into and out of the each piston chamber. The fluid control arrangement may for example comprise a fluid passage to admit fluid into and out of the piston chamber.

The fluid passage may, in use, selectively communicate with a high-pressure fluid source and a low pressure fluid sink.

The fluid passage may communicate with a fluid inlet and a fluid outlet. The piston chamber may comprise a fluid inlet and a fluid outlet.

The fluid inlet may communicate with a high-pressure fluid source. The fluid outlet may communicate with a low pressure fluid sink. The fluid control arrangement may comprise an inlet valve and outlet valve, for regulating the flow of working fluid into and out of the piston chamber. Said inlet/outlet valves may be disposed in a respective inlet/outlet conduit.

A said inlet/outlet valve may be selectively openable and/or closable.

The fluid control arrangement may comprise one or more solenoid valves (i.e. electrically openable and/or closable). The fluid control arrangement may comprise one or more pressure actuated valves and/or mechanically actuated valves.

In use, working fluid may be introduced into the piston chamber to a first side of the piston, to urge the piston away from the first position and towards the second position. Working fluid may be introduced into the piston chamber to a second side of the piston, to urge the piston away from the second position and towards the first position. When high pressure working fluid is introduced into the piston chamber to one side of the piston, low pressure working fluid may be vented from the piston chamber on the other side of the piston.

By controlling flow of working fluid in this way, the actuator may be selectively controlled between the first and second positions and, in some embodiments, one or more intermediate positions.

Each said piston may comprise a fluid passage and fluid flow into and out of each piston chamber may be regulated by the fluid control arrangement.

The piston may be moveable to translate between the first and second positions. The actuator may for example be a fluid linear actuator. As described below, a translational motion along a pathway comprising more than one linear vector and/or a curved or orbital pathway may also be possible).

The piston may be rotatable between the first and second positions. The actuator may for example be a fluid rotary actuator.

The term "translation", as between first and second positions, includes rectilinear motion, in which all point of the respective parts move by a specified distance. A translational motion may be along a straight line, or may comprise motion along a series of vectors. For example, a translational motion along a pathway may include an orbital motion about a remote point or axis, motion along a curve, etc. In contrast, terms such as "rotation", "rotatable" and "rotate" concern motion in which the relative orientation of the respective parts change, around a point or an axis common to the moveable parts.

In embodiments comprising a fluid rotary actuator, the actuator may comprise a vane piston which is pivotable or rotatable about a rotation axis, within an internal chamber.

The vane piston may comprise one or more vanes. Each vane may comprise a root portion, coupled to or formed integrally with a hub portion, and a tip portion at the distal end of the vane from the rotation axis. The hub portion may be coupled to the drive structure.

In use, a pressure differential across a vane may cause the vane to rotate around the rotation axis.

In a second aspect of the invention, therefore, there is provided a fluid rotary actuator, comprising an actuator body a vane piston within the actuator body, and coupled to a drive structure (such as a drive shaft);

the actuator body and vane piston together defining a piston chamber;

the vane piston rotatable around a rotation axis to vary the volume of the piston chamber, under the action of a working fluid within the piston chamber.

The vane piston may be rotatable between first and second positions.

The actuator body may define an internal chamber. The vane piston and the internal chamber may together define the piston chamber. The volume of the piston chamber may vary with rotation of the vane piston within the internal chamber.

The vane piston may be movable responsive to a fluid pressure differential across the vane piston.

The flow of fluid into and out of the piston chamber may be regulated by a fluid control arrangement.

The actuator may comprise a piston chamber to each side of the vane piston (or each vane, where the vane piston comprises more than one vane). That is to say, the vane piston may divide the internal chamber into two pistons chambers.

The vane piston may be coupled to the drive structure by any suitable means, and for example may be formed integrally with the drive structure, welded or bolted thereto, secured by a cooperative formation such as a spline, etc.

The actuator may be used with a test tree, for example according to the first aspect.

The actuator body may form part of a housing, such as a test tree housing. The actuator body may be sized to fit in a cavity in a housing.

The actuator body may comprise an actuator cover, which may provide access to the piston chamber, for maintenance etc.

The internal chamber within which the vane rotates may be generally in the form of a cylindrical segment. The piston chamber may be defined in part by the actuator body. The piston chamber may be defined in part by the actuator cover and/or the vane piston.

The actuator body may be cylindrical. The actuator body may be cylindrical around the rotation axis. An outer profile of the actuator body may define a part-cylindrical profile having an axis normal to the rotation axis.

For example, the actuator may be for use with a test tree having a cylindrical housing.

The rotational axis of the vane piston may be normal to (e.g. radial) to an axis through the actuator body (or the housing, as the case may be). For example, the vane piston may be coupled to a drive shaft extending to a rotary valve positioned in a fluid flow path.

The vane piston may comprise a tapered vane. The vane may be tapered with distance away from the rotation axis. The width and/or the thickness of the vane piston may taper.

The width of the vane (around the rotation axis) may decrease with distance from the rotation axis. The vane may be thicker at the stem than at the tip. The vane may be generally trigonal, for improved mechanical strength. The vane may be thickest at or towards the hub. The thickness of the vane at the hub may be greater than the thickness of another portion of the vane.

The vane may taper outwardly from the tip. Each vane may taper along at least a part of its length, towards the hub.

One or both faces of the vane may be flat, or may be curved (e.g. to accommodate an inflatable bladder in the piston chamber, as mentioned below).

A face of the vane within the piston chamber may be radially aligned with the rotation axis. One or both faces of the vane may be parallel with a radius from the rotation axis.

The thickness of the vane piston (in the direction along the rotation axis) may decrease with distance from the rotation axis.

An edge of the vane may be curved, such that the thickness of the vane decreases non-linearly with distance from the rotation axis.

This configuration has particular application to an actuator within a cylindrical actuator body, because a vane piston having a tapered (e.g. curved) thickness may better conform within the curvature of a cylindrical body. This arrangement may also allow the actuator to be positioned closer to the outer surface of the actuator body. For example, the actuator may be positioned closer to the outer surface of a cylindrical housing, e.g. of an SSTT, which may in turn be able to accommodate allowing a larger diameter throughbore, internal valves and so forth.

The radial cross section of the piston chamber may be substantially invariant around the rotation axis. The radial cross section of the piston chamber may be substantially the same as that of the vane piston. Thus, the vane piston may move within the piston chamber throughout its range of rotational motion.

An inner face of the piston chamber (e.g. that defined by the actuator outer casing) may be a part-spherical surface. The depth of the vane piston may be provided with substantially the same curvature, with distance from the rotation axis.

An inner face of the actuator outer casing may be a part spherical surface.

The vane piston may comprise two or more vanes. Each vane may be rotatable within corresponding internal chambers. The vane piston may have vanes extending in diametrically opposite directions from the hub.

Additional vanes or vane pistons may provide for a multiplication in the torque applied. An increase in the applied torque may also result from increased thickness of the or each vane and of the corresponding piston chamber(s).

The actuator may comprise two or more vane pistons. The actuator may comprise two or more vane pistons having a common rotation axis. The actuator may comprise two or more vane pistons attached to a common drive structure, e.g. extending from a common hub. The actuator may comprise diametrically opposed vane pistons, for example extending from a common hub.

The actuator may be adapted for use with a rotary valve, such as a ball valve or a rotary actuated flapper valve (e.g. a rotary valve comprising a rotary carriage and a flapper valve member moveably attached to the carriage).

A rotary actuator, and in particular a fluid rotary actuator, may be convenient for this purpose. Unlike conventional actuation of a rotary valve using an actuator within the housing, by attaching the rotary actuator to housing, the leverage which may be applied by the actuator is not limited by the diameter of the rotary valve or the throughbore.

Moreover, a fluid rotary actuator having diametrically opposed vanes, as described herein, may be configured to apply equal force or torque around a drive shaft. Accordingly, no net linear force is applied perpendicular to the rotation axis, in use, which might otherwise lead to binding of the drive shaft and/or of a rotary valve mechanism. Binding of rotary valves, for example by driving a rotary valve member into a valve seat, is a known problem of conventional linear to rotational mechanical actuators (e.g. comprising sleeves and pins extending from a ball valve member), and is addressed by the present invention.

The actuator may comprise an inflatable bladder disposed within the piston chamber. As described in additional detail below, in use, the bladder may be inflated with a working fluid and expansion of the bladder may cause the piston to move within the piston chamber.

An inflatable bladder isolates the walls of the piston chamber, the piston and any seals therebetween, from the working fluid. Thus, the actuator may be less susceptible to contamination or degradation of working fluid. Moreover, sliding seals between the piston and the piston chamber are not required to seal across a large pressure differential.

The actuator may comprise an inflatable bladder in the piston chamber on each side of the piston.

The actuator may comprise one or more further pistons or piston chambers, for example as described above in the case of a rotary valve having diametrically opposed vane pistons.

The housing may comprise more than one actuator.

The housing may comprise more than one actuator operatively connected to the same valve.

More than one actuator may be coupled to a common drive structure. For example, each of two rotary actuators may be coupled to a drive shaft.

The test tree may comprise an actuator on opposite sides of the housing, which may be operatively connected to the same valve. The force applied to a rotary valve (or other rotary internal workings) by diametrically opposed rotary actuators, for example, may be additive.

The housing may comprise more than one valve. Valves may be distributed, for example along an axis of a cylindrical housing.

Each valve may be associated with an actuator or actuators on diametrically opposite sides of the housing.

An actuator associated with one valve may be axially and/or circumferentially offset from an actuator associated with an adjacent valve.

Circumferentially offset actuators, may enable the actuators associated with adjacent valves to be positioned close together, in particularly axially.

Moreover, location of the actuators outside of the housing (e.g. in a recess) and/or the use of rotary actuators obviates the requirement for internal sliding sleeves, spring stacks, elongate linear actuators and the like, which would otherwise necessitate additional space between adjacent valves.

In particular, the rotary and fluid rotary actuators disclosed herein which are circumferentially offset from one another may in part axially overlap (which is not possible for sliding sleeve actuators, for example).

Thus, the invention provides for more compact packaging of multiple valves, or for additional valves to be provided within a given space. For example, an SSTT may be provided with larger isolation valves, or indeed an additional isolation valve, in the space afforded within a BOP.

It is also to be understood that similar advantages and may be conveyed with non-cylindrical housings.

In embodiments comprising an inflatable bladder disposed within the piston chamber (or each piston chamber), a fluid passage may communicate with an inside of the inflatable bladder. A fluid inlet and a fluid outlet may communicate with the inside of the bladder. The fluid passage may communicate with a fluid inlet and a fluid outlet.

The bladder may be sealed around the fluid passage (or the inlet and outlet, as the case may be), for example by way of a neck portion extending between the fluid passage and a main body of the inflatable bladder.

The piston may be provided with a concave profile adapted to receive the bladder. For example, a bladder-facing surface of a vane piston may be curved or concave. A curved or concave profile may reduce the angle at the interface between the piston and the piston chamber and so mitigate against trapping or extrusion of the bladder.

The inflatable bladder may comprise a fluid-tight layer. The fluid-tight layer may comprise or be formed from a flexible, fluid-tight material. The inflatable bladder may comprise a resilient or elastomeric material, and/or a plastics, polymeric or rubber material, such as a nitrile or silicone material.

In use in high pressure environments, a bladder may be prone to extrusion through small gaps, e.g. between the piston and cylinder. A bladder may also be prone to "blistering"; i.e. if a region of the bladder is held against the piston chamber wall by high pressure fluid within the bladder, an adjacent region of the bladder may be prone to excessive expansion (possibly resulting in permanent deformation or even tearing) during subsequent inflation.

In order to prevent deformation of this type, at least a portion of the bladder, and optionally the substantially all of the bladder, may comprise an anti-deformation layer.

An anti-deformation layer may be stiffer than the fluid-tight layer, less elastic than the fluid-tight layer and/or thicker than the fluid tight layer.

An anti-deformation layer may comprise a layer of flexible fabric, such as a Kevlar or metal fabric. A fabric layer may resist excessive stretching and/or extrusion of the fluid-tight material.

An anti-deformation layer may comprise a resilient or elastomeric material, e.g. a plastics, polymeric or rubber material.

The inflatable bladder may comprise a shape-memory material, capable of elastic deformation during inflation and which returns to a predefined shape/configuration when deflated. The anti-deformation layer and/or the fluid-tight layer may comprise a shape-memory material. A suitable shape memory material may for example comprise a rubber, or elastomeric material.

A bladder which become elastically deformed when inflated in use, and which returns to a predefined shape/configuration when vented may resist against "pinching" during the reduction in the volume of a piston chamber.

The anti-deformation layer may be an external layer, or may be embedded within or between fluid-tight later(s).

The bladder may comprise an outer anti-deformation layer and an inner fluid-tight layer.

The anti-deformation layer may be fixed to the fluid tight-layer, for example by gluing to or embedding into the fluid-tight layer.

The anti-deformation layer may be fixed to the fluid-tight layer across the entire interface between the layers, or alternatively only in one or more specific regions. The fluid-tight layer may be free to move in relation to the anti-deformation layer.

The anti-deformation layer may itself be fluid tight or alternatively may comprise one or more, or a plurality, of perforations. Thus, fluid (e.g. grease or a low pressure fluid within the cylinder) may be admitted between the anti-deformation and fluid-tight layers, so as to provide lubrication. In this way, the tendency of the fluid-tight layer to become fixed in relation to the piston chamber walls may be reduced.

Accordingly, the invention extends in a third aspect to a fluid actuator comprising;

a piston chamber of variable volume (for example by movement of a piston member within an internal chamber);

an inflatable bladder disposed within the piston chamber, an inside of the bladder in communication a fluid passage by which a working fluid may flow into and/or out of the bladder; and the inflatable bladder comprising an outer anti-deformation layer and an inner fluid-tight layer, wherein the inner and outer layers are moveable in relation to one another.

The actuator may comprise or be connectable to a fluid control arrangement for controlling the flow of a working fluid into and out of the bladder.

The layers may be secured together at one or more points or an array of points across the surface of the bladder. The layers may be secured together only in the region around the fluid passage (or around an inlet and/or outlet, where present). The anti-deformation layer may not be secured to the fluid-tight layer at all. For example, both of the layers may be secured independently to the cylinder body.

The anti-deformation layer may be provided with one or more, or a plurality, of apertures. The anti-deformation layer may be perforated. The anti-deformation layer may for example comprise a fabric material or a perforated resilient material, through which fluid can pass.

The actuator may be for use with a test tree as described herein.

The invention also extends in a further aspect to an inflatable bladder for use in a fluid actuator, comprising an outer anti-deformation layer and an inner fluid-tight layer; the inner and outer layers moveable in relation to one another. The inner fluid-tight layer may comprise an aperture, connectable a fluid passage of a said actuator. The fluid-tight layer may comprise more than one aperture, for example for connection to each of a fluid inlet and a fluid outlet.

The walls of the bladder (or of an anti-deformation layer or a fluid-tight layer thereof) may be of variable thickness. For example, regions coming into contact with an interface between the piston chamber and the piston may be thicker than other regions of the bladder walls, to resist against extrusion.

The bladder may be adapted to fold or collapse (and thus also to unfold and inflate) in a predetermined manner (e.g. to conform to the internal dimensions of the piston chamber throughout the range of motion of the piston).

The bladder may be configured in the form of bellows. The bladder may be provided with ribbing, about which the bladder can fold/collapse in use. The ribbing may take the form of a structural member. The ribbing may be provided by way of variations in the thickness of the walls of the bladder.

The bladder may be resiliently biased away from a folded configuration and towards an inflated or unfurled configuration. The bladder may be resiliently biased towards a folded configuration and away an inflated or unfurled configuration. This may mitigate against folding/trapping of the bladder walls against the inside of the piston chamber.

The (or each) piston chamber may, in some embodiments, comprise more than one inflatable bladder. A piston chamber may comprise two or more inflatable bladders in series. The inflatable bladders may be inflated or deflated sequentially, so as to move the piston. A series of inflatable bladders may facilitate selective control between first and second and one or more intermediate positions of the piston.

Where a piston required to seal within an internal chamber against a pressure differential (so as to define a piston chamber), a generally circular in cross section is typically most convenient and reliable. However, where the piston chamber is required only to retain an inflatable bladder, larger tolerances are possible and alternative cross sections, such as square, ovoid, polyhedral, a vane piston within a cylindrical-segment shaped chamber etc. are made possible. Such alternative configurations may enable an actuator in accordance with the invention to fit within a smaller space, for example in a test tree sized to fit in a BOP stack.

Moreover, an inflatable bladder may be retained within any chamber having a variable volume.

Accordingly, in a fourth aspect, the invention extends to a fluid actuator comprising; an actuator body; and a drive structure moveable (e.g. slideable) in relation to the actuator body, and connectable to external apparatus;

the drive structure and the actuator body together defining a chamber having a volume which varies with motion between the drive structure and the actuator body; and an inflatable bladder disposed within the chamber; an inside of the bladder in communication with a fluid passage by which a working fluid may flow into and/or out of the bladder.

The drive structure may be moveable in relation to the actuator body between a first position and a second position. The drive structure may translate in relation to the actuator body between the first and second positions. The translational motion may be straight curved (e.g. orbital) or a combination thereof.

The actuator body may define an end wall. The drive structure may define an opposing end wall. In use the bladder may expand against opposed end walls and cause movement between actuator body and the drive structure, for example between the first and second positions.

The drive arrangement (or the actuator body) may comprise a piston member, extending into the chamber. The piston member may define a piston chamber, together with the drive arrangement and/or the actuator body. A piston chamber may be defined on each side of the piston member.

The actuator may comprise a bladder in the chamber on each side of the piston member.

A sliding interface between the drive structure and actuator body may be more complex than a conventional cylinder/piston arrangements, which is made possible by the use of a bladder.

The actuator body may comprise an open cavity and the drive structure may cover the open cavity, and define the remaining wall(s) of the chamber (or vice versa).

The drive structure may comprise a generally planar portion and the piston member may extend from the planar portion into the open cavity (or vice versa).

The drive structure and the actuator body may be moveably secured together by any suitable means.

The actuator body or the drive structure may comprise a slot, and a guide formation such a bolt may extend from the other of the actuator body or the drive structure, through the slot. The guide formation may be retained within the slot by a retaining formation (such as a nut threaded around the bolt).

The drive structure may move between the first and the second position along a defined pathway. The defined pathway may be defined by one or more of; the interlocking arrangement; the shape/configuration of the actuator body; the shape/configuration of the drive structure.

The defined pathway may be straight. The defined pathway may be a curved pathway. The defined pathway may comprise one or more straight or curved portions in series. Adjacent portions of the pathway may have a different vector (e.g. different linear vectors). As a whole, therefore, the defined pathway may be non-linear.

In a fifth aspect of the invention, therefore, there is provided a fluid actuator comprising;

an actuator body; and a drive structure connectable to external apparatus;

the drive structure and the actuator body together defining a chamber having a volume which varies with movement between the drive structure and the actuator body; and the drive structure translationally moveable in relation to the actuator body along a non-linear pathway.

The non-linear pathway may be defined by one or more of; an interlocking arrangement between the actuator body and the drive portion; the shape/configuration of the actuator body; the shape/configuration of the drive structure.

The drive structure may be moveable to translate between a first position and a second position, in relation to the actuator body.

An inflatable bladder may be disposed within the chamber, an inside of which is in communication with a working fluid, via a fluid passage or passages.

The chamber may comprise two or more inflatable bladders in series. Each bladder may correspond to a portion (e.g. a respective straight or curved portion) of the defined pathway.

The actuator may comprise a piston member extending into the chamber. The piston member may define a piston chamber, together with the actuator body and/or the drive structure. A piston chamber may be defined to each side of the piston member. A bladder may be disposed in each piston chamber.

This arrangement may enable the actuator to be selectively controlled between the first and second positions.

The actuator body may comprise more than one actuator body portion. For example, an actuator body portion may be moveably connected to each side of the drive structure, and each portion may, together with the drive structure, define a respective chamber or chambers having a volume which varies with motion between the drive structure and the actuator body.

This arrangement may serve to balance forces applied to the drive arrangement in use, and/or increase the surface area over which forces are applied between the moveable parts.

The actuator body portions may be symmetrically disposed about the drive structure. The actuator body portions may be coupled to one another around or through the drive structure (e.g. by bolts extending between the actuator body portions, through slots in the drive structure).

An actuator comprising two or more inflatable bladders in series and/or more than one piston chamber, may be configured for use with more than one working fluid, or more than one working fluid pressure.

For example, a greater force/torque may be required to move the actuator from a first position to a second position, than vice versa. For example, a very high force may be required to close an emergency isolation valve against apparatus (e.g. coiled tubing or wireline) extending through the valve and so the working fluid pressure used to close the valve may be higher than the pressure required to open it. Similarly, the actuator may be required to apply a greater force during certain portions of the movement between the first and second positions (e.g. a final closure or a cutting force).

A series of inflatable bladders and multiple chambers or piston chambers enables each to be configured according to a particular operational requirement (e.g. adapted to withstand a given internal pressure, or to inflate at a given rate, etc.).

Preferred and optional features of each aspect of the invention correspond to preferred and optional features of each other aspect of the invention.

It is to be understood, for example, that the test tree as disclosed herein may comprise any configuration of actuator, or any combination thereof, in accordance with any aspect.

Furthermore, the aspects of the invention may be applied to a test tree may be for in-riser use, or alternatively for open water applications. Moreover, the invention is not limited to a subsea test tree and may be applied to other environments, such as fresh water or wells on land. Thus, the invention extends to a test tree comprising a housing an actuator as described above.

The invention provides for improved utilization of available space, which is applicable not only to subsea test trees but to other applications in which an actuator is used. The invention provides for additional space within a housing, or additional actuator power, number of actuators and/or internal valves or other workings, which may be accommodated within an available space.

BRIEF DESCRIPTION OF THE DRAWINGS

Example embodiments will now be described with reference to the following figures in which.

DETAILED DESCRIPTION OF THE DRAWINGS

Figure 1:
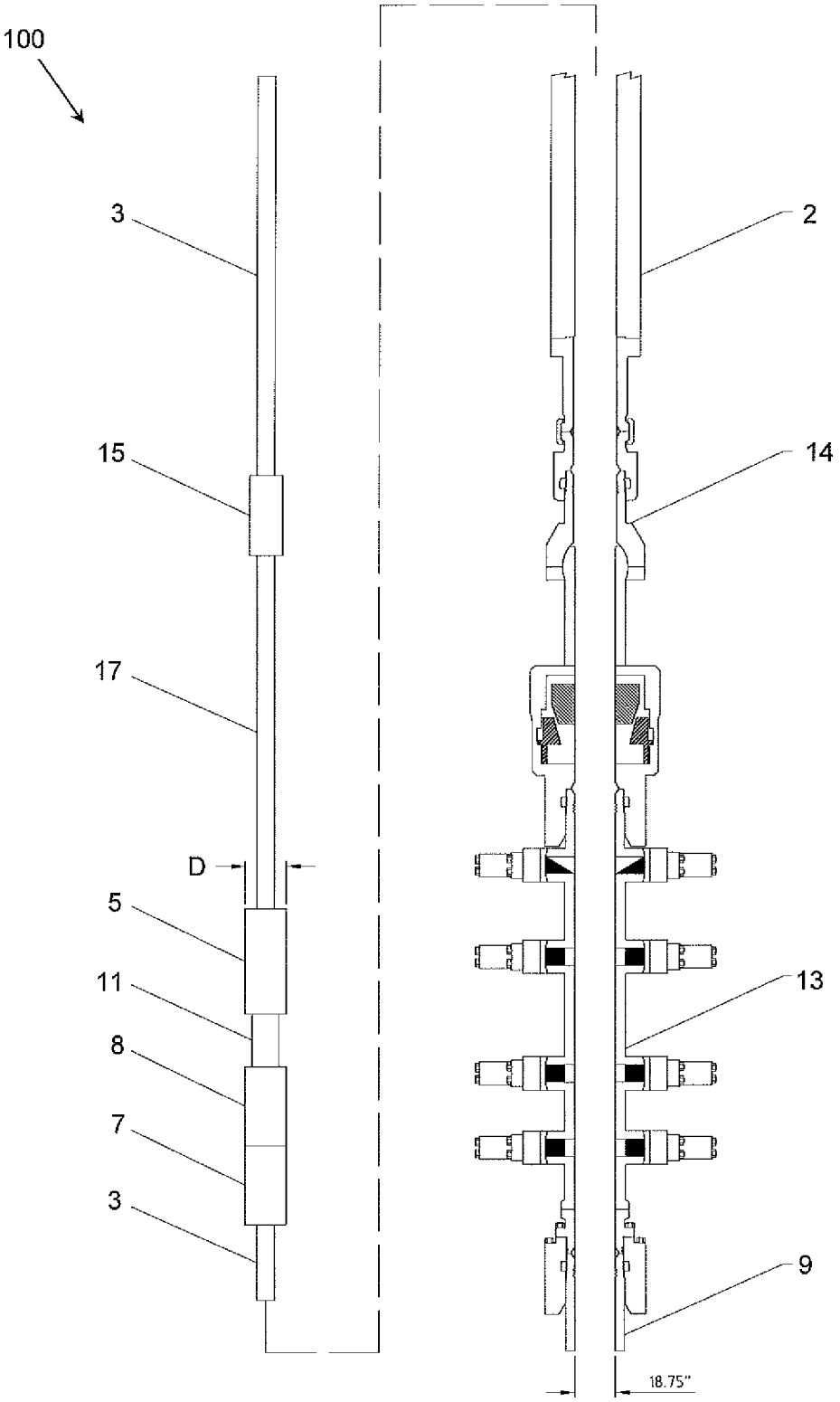
FIG. 1 shows a schematic cross section of a lower landing string assembly and a marine BOP.

FIG. 1 shows a typical landing string configured for performing wellbore interventions. The landing string 100 is run into a marine riser 2 in riser tubing 3, which is coupled to a blow-out preventer (BOP) 13 via a flex joint 14. A flow path extends through the riser tubing 3, the landing string 100 and its component parts, and in use provides access to a well for fluids, tools (run on wireline or tubing) or other apparatus/materials as required in an intervention.

The landing string 100 includes a Sub Sea Test Tree 5, comprising a double barrier valve system.

Figure 2:
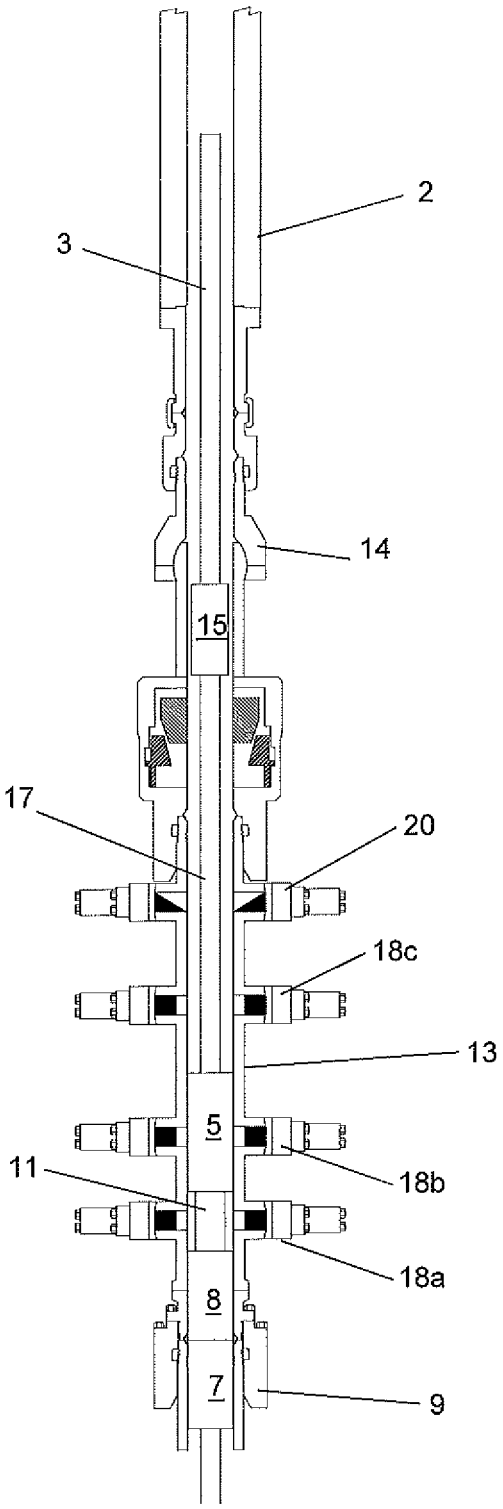
FIG. 2 shows the landing string fully landed out within the marine BOP.

The SSTT sits in the landing string above a tubing hanger 7, which is adapted to couple the landing string to the wellhead 9. A tubing hanger running tool 8 may also be provided to run the landing string to the wellhead along the marine riser 2 and couple the tubing hanger 5 to the wellhead 9, as shown in FIG. 2.

Between the SSTT 5 and the tubing hanger and running tool 7, 8 is a slick joint 11 having a smooth outer surface against which a pipe ram within a BOP 13 can form a seal in case of emergency (as described below with reference to FIG. 2).

In addition to the double barrier system within the SSTT, further valves may also be provided which sit above the BOP when the landing string has been deployed, such as a retainer valve 15.

The landing string 100 must be provided with the capacity for emergency disconnection of the retainer valve 15, the riser tubing 3 above the SSTT and any further apparatus above the SSTT, by way of a severable shear joint 17.

All of the components of the landing string 100 are constrained to fit within the diameter of the riser 2. The components below the shear joint 17 must also fit within the BOP 13, as shown in FIG. 2. Accordingly, a maximum diameter D (in the example shown, 18.5 inches (or around 47 cm) is permitted.

FIG. 2 shows the landing string 100 fully landed out within the marine BOP 13. The BOP 13 includes a series of pipe rams 18*a-c* operable sealing around the landing string at selected points (in the example shown, around the SSTT, slick joint and the shear joint), in order to isolate the annulus around the landing string. Fewer or a greater number of shear rams may alternatively be present. In addition, the BOP 13 comprises a shear ram 20, operable to sever the shear joint 17 in case of extreme emergency.

An additional requirement of the landing string is that the SSTT must be contained within the BOP 13 beneath a shear ram 20. Thus, a limited height along the landing string axis is available within which to fit the SSTT 5.

Figures 3, 4:
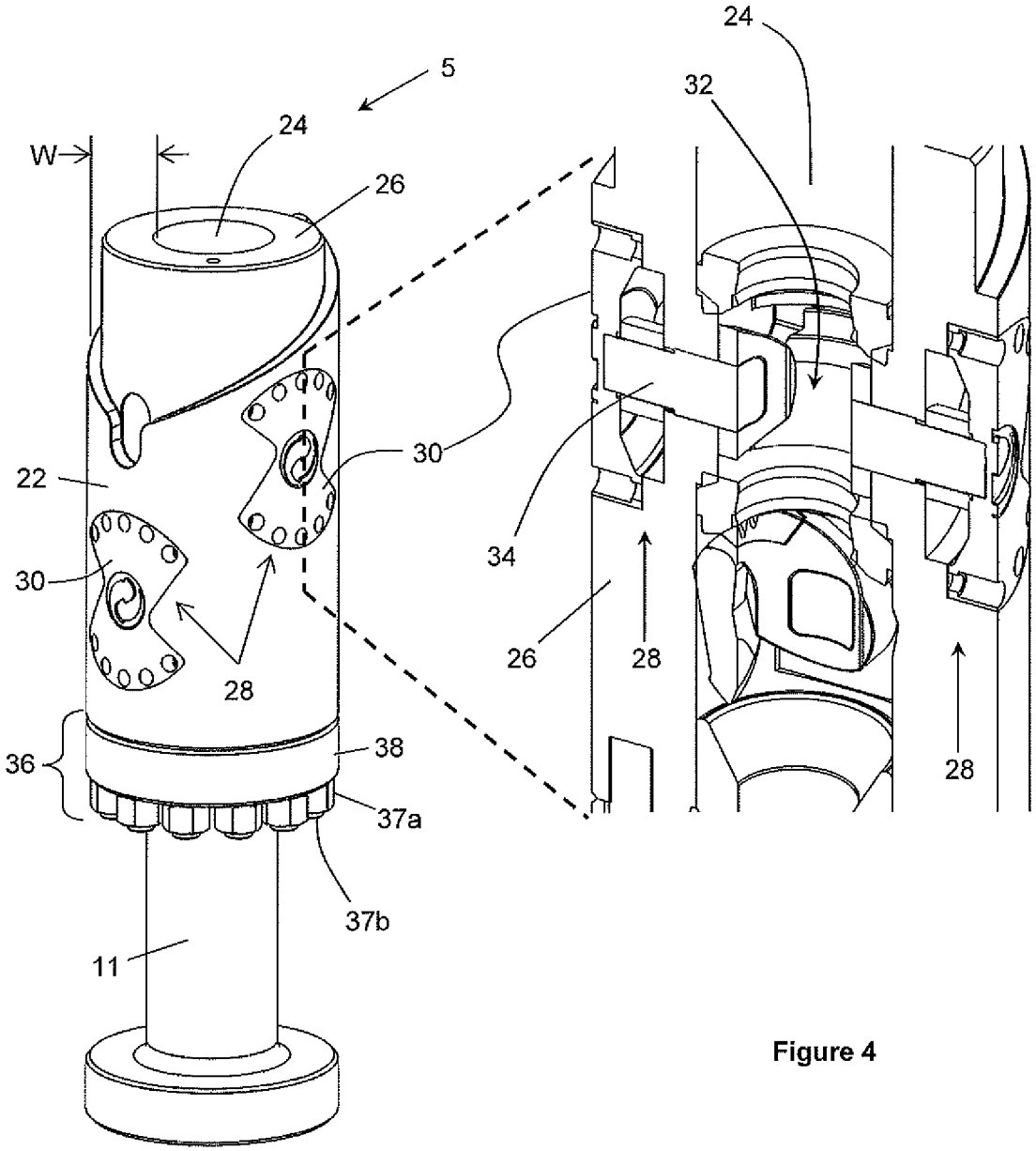
FIG. 3 shows a Sub Sea Test Tree in accordance with the invention.
FIG. 4 shows a cross sectional view of a part of the SSTT of FIG. 3.

The SSTT 5 is shown in further detail in FIG. 3. The SSTT includes a cylindrical housing 22 having a flow path 24 extending therethrough (in the form of a throughbore). The housing wall 26 has a thickness W. An actuator 28 is coupled to the housing beneath each actuator cover 30.

As can be seen in the cross sectional view of FIG. 4, each actuator is mounted within a recess in the housing wall.

Each actuator is coupled to a valve, indicated generally as 32, mounted in the housing, via a drive structure 34 (in example shown, in the form of a drive shaft) which extends through the housing wall 26. The housing wall 26 is sealed around the drive shaft 34 by a dynamic packer seal (not shown), so as to isolate the actuator 28 from the fluid environment within the housing 26.

The efficient packaging of the SSTT 5 enables the housing wall thickness W to be sufficient for the SSTT to be coupled to the adjacent slick joint 11 by a conventional and highly secure flange joint 36. An array of hex nuts 37*a* is threaded over bolts 37*b* extending from the housing 22 and through the flange 38 of the slick joint. Accordingly, the use of specialist thin-wall tubing for the housing, and specialist connections to adjacent apparatus in the landing string, is not required.

In the embodiment shown, the valve is a rotary valve and the SSTT includes rotary actuators, although the invention is not limited to any particular form of valve or actuator. Indeed in alternative embodiments, there may be a different number or arrangement of valves or actuators.

Figure 6:
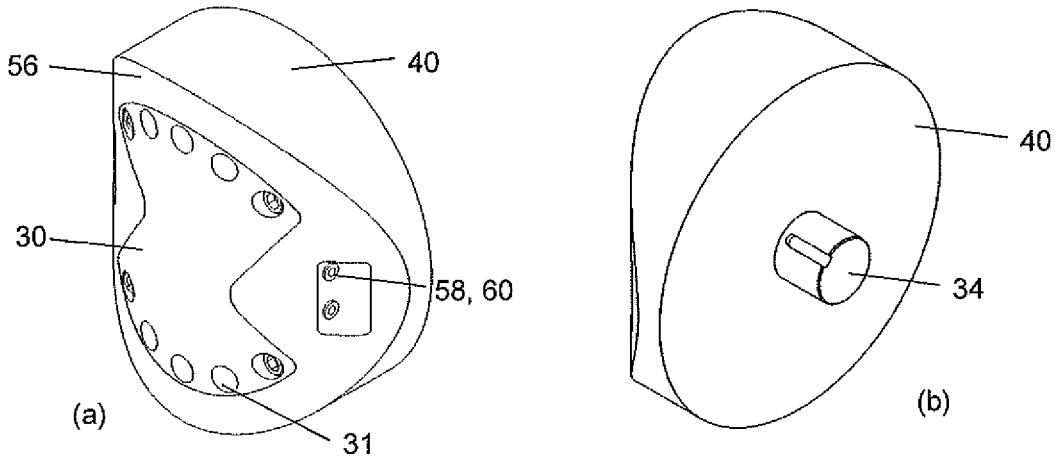
FIG. 6 shows a perspective (a) front and (b) rear view of the actuator of FIG. 5.

FIG. 6 shows an exploded view of an actuator 28, which is a rotational fluid actuator (in the present case, hydraulic). The actuator includes an actuator body 40, which is sized to fit within a recess in the wall 26 of the housing 22. In alternative embodiments (not shown) the actuator body forms part of the housing 22 itself, and various parts of the actuator may be defined by the test tree housing 22.

The drive shaft 34 extends through an aperture 42 of the actuator body and is coupled, via a spline portion 35, to a vane piston 44. The vane piston includes a hub portion 46, having spline fittings 48 around an inside of an aperture through the hub, to enable the vane piston to be coupled to the spline portion 35 of the drive shaft 34.

The vane piston also includes vanes 50, extending from diametrically opposite sides of the hub 46. The vanes taper from tips 51 to a root portion 52. Each vane 50 is both wider (around the rotation axis A) and thicker (along the rotation axis A) at the root 52 than at the tip 51. The increased width of each vane, such that the vane is general trigonal as viewed along the rotation axis A, improves the mechanical strength of the vane piston.

The actuator body defines a cavity 54 in its outer face 56 sized to receive the vane piston 44. An actuator cover 30 is bolted (by bolts 31) over the cavity 54, so that the actuator cover and the actuator body together define an internal chamber. In use, the vane piston is operable to rotate around the axis A within the internal chamber, as described below.

Fluid passages 58 extend through the actuator body 28 to the cavity 54 (and thus the internal chamber). The actuator is also provided with a fluid control arrangement, for regulating the flow of high pressure hydraulic fluid into, and of low pressure hydraulic fluid out of, the internal chamber in use. Fluid flow conduits 60, which extend to the fluid control arrangement, are shown in the figures. Further features of a fluid control arrangement for controlling the operation of a hydraulic actuator are well known in the art and are not described in further detail herein.

FIGS. 6(*a*) and (*b*) show perspective view of the front and rear faces of the actuator 28. As most clearly shown in FIG. 6(*a*), the outer face 56 of the actuator body 40, and the outer face of the actuator cover 30, both define portions of a cylindrical surface. Thus, the outer surfaces of the actuator lie flush with the outer surface of the test tree housing 22. Accordingly, the actuator is compatible with the largest diameter housing capable of fitting within the BOP. In addition, by maintaining the SSTT within a cylindrical envelope in this way, the SSTT may be run through apparatus such as a lubricator or a rotating table.

Figure 5:
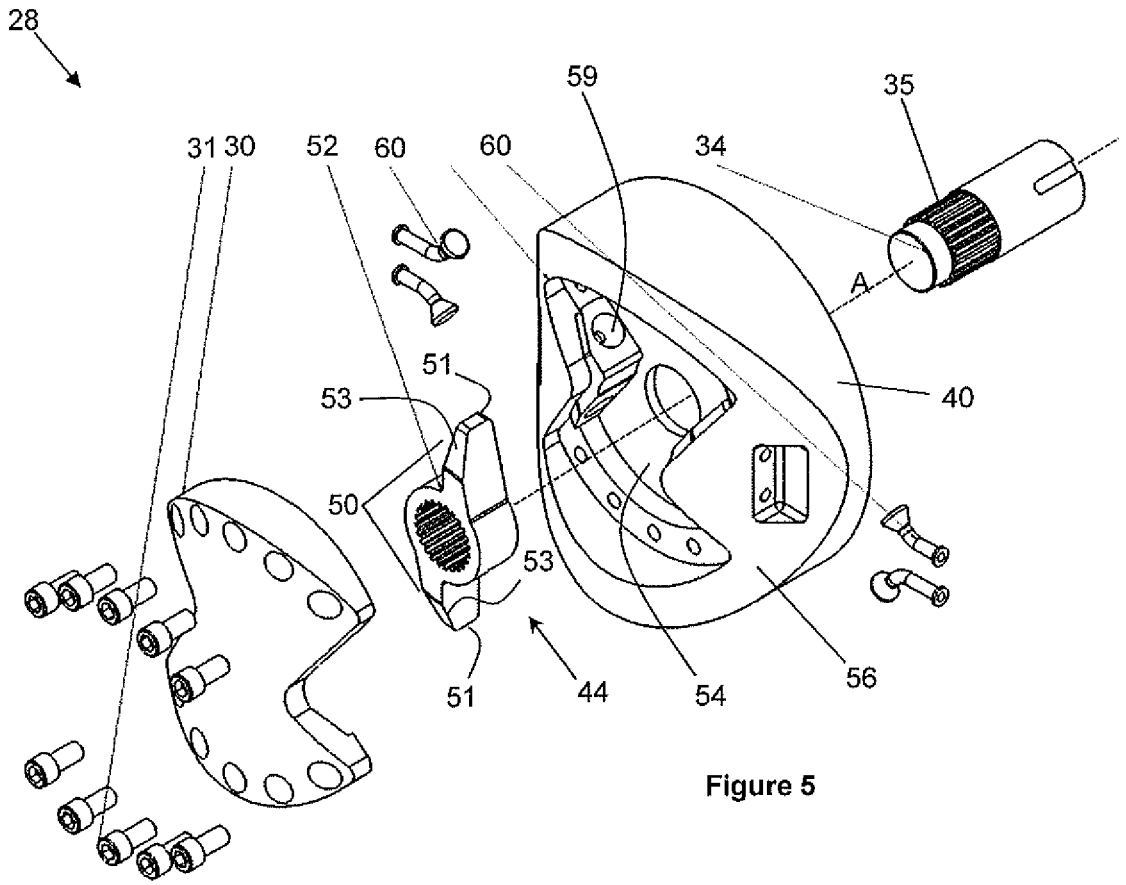
FIG. 5 shows an exploded perspective view of a fluid rotary actuator.

Portions of an inside surface of the actuator cover proximate to the vanes 50 in use (which is not visible in the figures) are provided with a part-spherical profile. As mentioned above, the vanes 50 are tapered, such that their thickness decreases towards the tips 51. The tapered edge portion 53 (shown in FIG. 5) is provided with a curvature which matches the curvature of the inner face of the cover 30. Thus, the radial cross section of the internal cavity matches that of the vane piston, throughout its range of rotation about the axis A. Moreover, the curvature of the vanes 50 and cover 30 ensure that the vane piston may be located as closely as possible to the outer face of the actuator body 28 and the housing 22.

Figure 7:
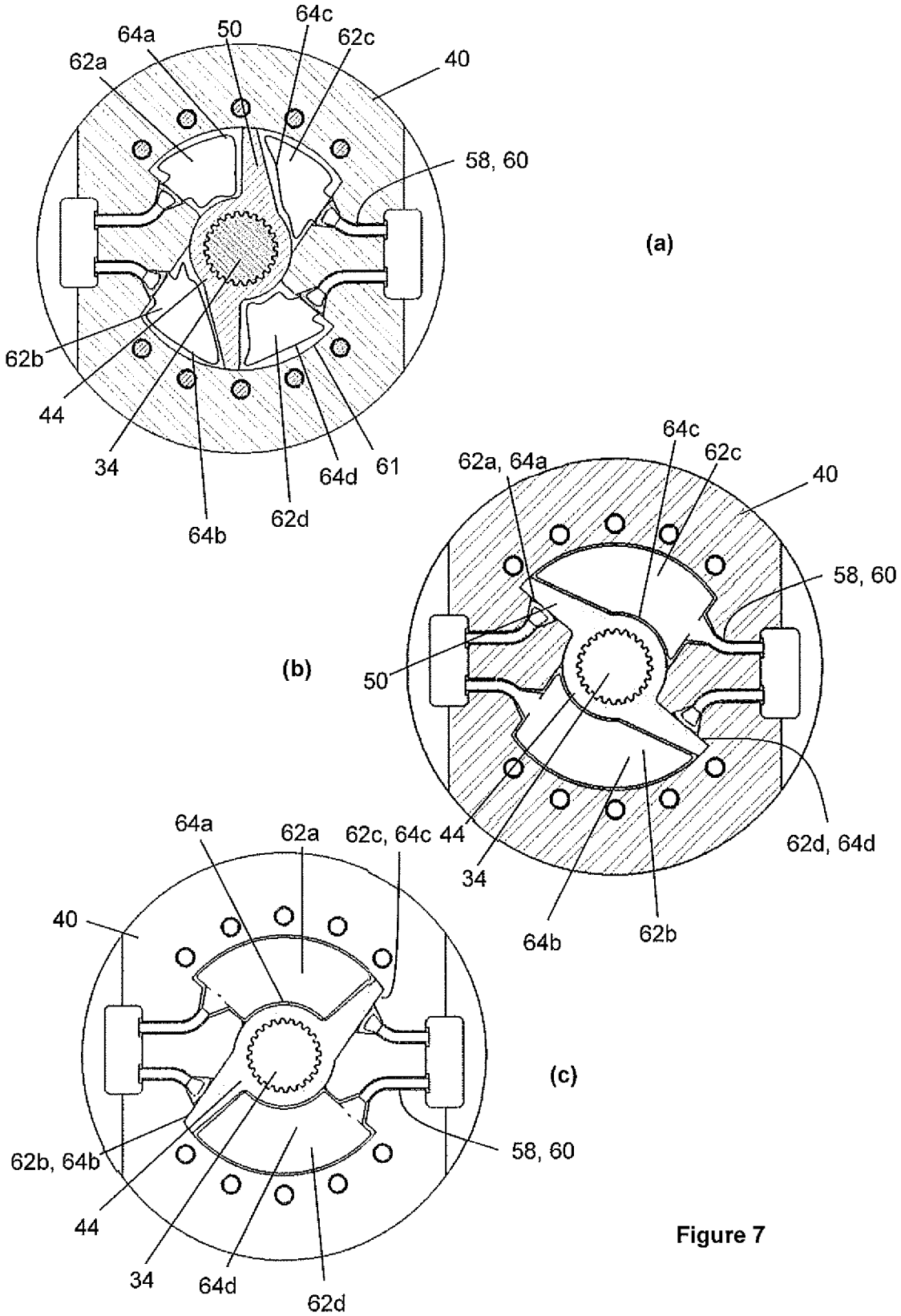
FIG. 7 shows a cross sectional view across the rotation axis of the fluid rotary actuator of FIG. 5, showing a vane piston in (a) an intermediate position (b) a first position and (c) a second position.

Operation of the actuator 28 is shown in FIG. 7. FIG. 7 shows that vane piston 44 in the internal chamber 61. The internal chamber is divided by the vane piston into four piston chambers 62*a-d*. Each piston chamber is defined in part by the actuator body 40 (which may form part of the housing 22), by the vane piston 44 and by the actuator cover 30. Each piston chamber communicates with a fluid passage 58, through which the flow of working hydraulic fluid is controlled via conduits 60 connected to the fluid control arrangement.

In alternative embodiments, the vane piston 44 may seal against the actuator body 40 and the cover 30. However, the actuator 28 is provided with inflatable bladders 64*a-d* disposed within each piston chamber. The insides of the bladders communicate with the passages and conduits 58, 60. Accordingly, the piston chambers themselves are required only to contain the bladders, and not to seal against a pressure differential. Moreover, the various internal surfaces of the actuator are not directly exposed to the working fluid.

In order to move the vane piston 44 anticlockwise, so as to place it in its first position as shown in FIG. 7(*b*) (corresponding to a first configuration of the actuator as a whole), high pressure working fluid is caused to enter the bladders 64*b* and 64*c* in the piston chambers 62*b* and 62*c*, respectively. Working fluid within the bladders 64*a* and 64*d*, in piston chambers 62*a* and 62*d* are exposed to a low pressure fluid sink, such that a pressure differential is created across each vane 50 and working fluid is displaced from the bladders 64*a* and 64*d*, as the bladders 64*b* and 64*c* are inflated.

In order to move the vane piston 44 clockwise, so as to place it in its second position as shown in FIG. 7(*c*) (corresponding to a second configuration of the actuator as a whole), high pressure working fluid is caused to enter the bladders 64*a* and 64*d* in the piston chambers 62*a* and 62*d*, respectively. By way of the fluid control arrangement, working fluid within the bladders 64*b* and 64*c*, in piston chambers 62*b* and 62*c* are now exposed to a low pressure fluid sink, such that a pressure differential is created across each vane 50 in the opposite direction and working fluid is displaced from the bladders 64*b* and 64*c*, as the bladders 64*a* and 64*d* are inflated. Accordingly, the actuator may be selectively controlled between the first and second configurations, so as to open and close the associated valve as required.

The actuator 28 is provided with a vane piston 44 having diametrically opposed vanes 50. This ensures that the forces applied around the rotation axis are equal; i.e. that only rotational forces are applied to the drive shaft 32, and there is no net force applied normal to the rotation axis A. This arrangement mitigates against binding between the drive shaft and the actuator body 40. Moreover, in use with a rotational valve such as a ball valve, driving of the ball valve member into the valve seat (a known problem in use of balls valves with linear sleeve type actuators) is avoided.

It should also be noted that the tip-to-tip diameter of the vane piston may exceed the diameter of the rotational valve 32 and so the leverage or torque which may be applied to the valve is not limited by the valve diameter, as is the case for conventional sleeve-actuated rotational valves.

As can be seen in FIG. 4, the compact rotary actuators 28 are disposed on opposite sides of the housing 22. In addition, provision of the actuators 28 external to the housing, the actuators can be most efficiently spaced around the housing. As can be seen in FIG. 3, the actuators 28 are spaced apart axially along the housing and in addition, the actuators of adjacent valves are staggered circumferentially around the housing. This circumferential offset enables the actuators of adjacent valves to axially overlap, and provides for significant axial space savings.

As previously mentioned, the provision of an inflatable bladder within each piston chamber obviates the need for a fluid tight dynamic seal between a piston member and an associated internal chamber. In turn, this enables a range of different actuator geometries, which would not otherwise be practicable to manufacture or sufficiently reliable for industrial use.

Figure 8:
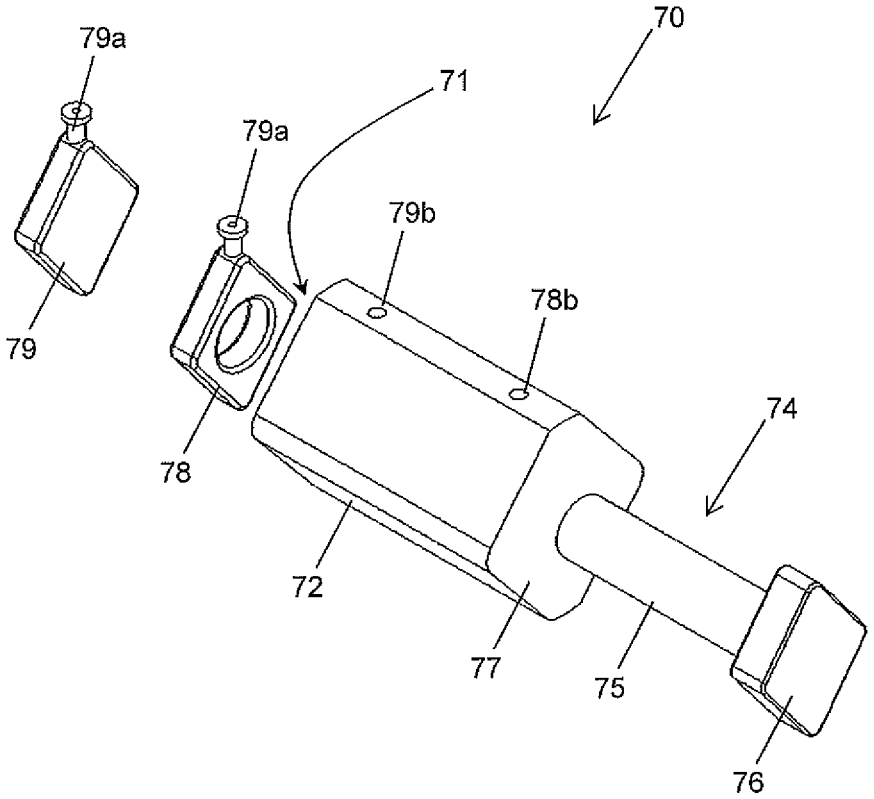
FIG. 8 shows an exploded perspective view of a diamond shaped fluid actuator.

FIG. 8 shows an alternative embodiment of an actuator 70. The actuator 70 comprises an actuator body 72 of diamond-shaped cross section. Slideable within a cavity 71 in the body 72 is a piston 74 having a diamond-shaped piston head (not visible in the figure) and a piston shaft 75, which is connectable to external apparatus via a flange 76.

An inflatable bladder 78 is provided with an aperture so as to fit around the shaft 75 between the piston head and the end 77 of the body 72. A further diamond-shaped inflatable bladder 79 is placed within the cavity 71 on the other side of the piston head. An inside of each of the bladders communicates with a fluid control arrangement via neck portions 78*a* and 79*a* and fluid passages 78*b* and 79*b* in the body 72. The end of the cavity 71 is covered by an actuator cover (not shown). The piston 74 may be caused to reciprocate within the cylinder by inflating/deflating the bladders 78, 79 generally as described above.

Figure 9:
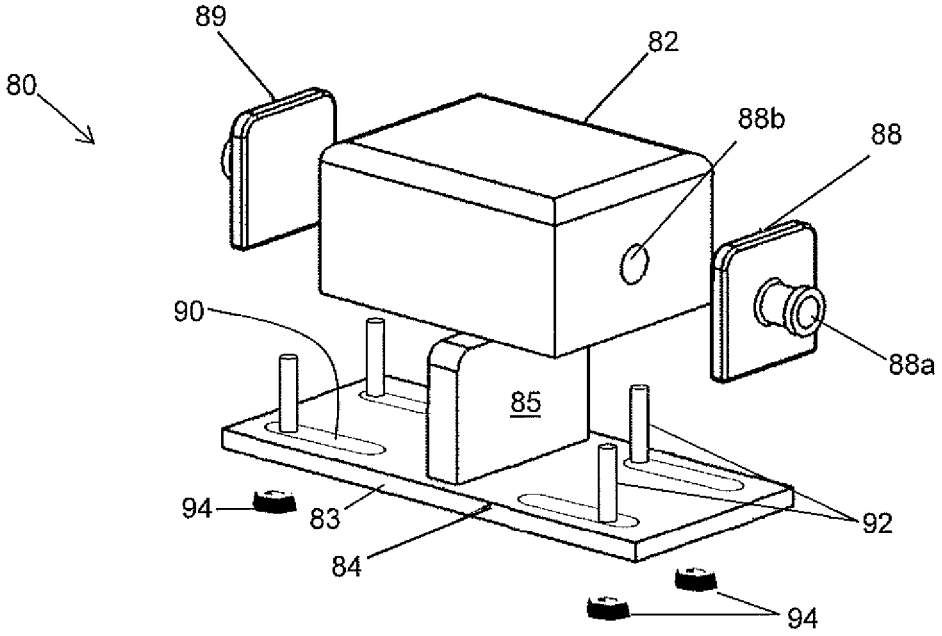
FIG. 9 shows an exploded perspective view of a linear fluid actuator.

FIG. 9 shows an exploded view of a still further embodiment of an actuator 80. The actuator 80 comprises an actuator body 82. The actuator body defines an open cavity 83. The actuator 80 also includes a drive structure 84, comprised of a planar drive plate 85 and a piston member 86 extending from the drive plate 85 into the cavity 83.

The drive plate 83 is provided with slots 90, and threaded bolts 92 pass through the slots and are threaded into threaded apertures in the actuator body 82 (not visible) and to nuts 94 on the underside of the drive plate. The actuator body 82 and the drive structure 84 are thereby secured together, and together define an internal chamber 96 (visible in FIG. 10). The body and the drive structure are moveable in relation to one another along a pathway defined by the slots. The piston member 85 divides the internal aperture into two piston chambers 97, 98.

An inflatable bladder 88 retained in one piston chamber and an inflatable bladder 89 is retained in the other piston chamber. An inside of each of the bladders communicates with a fluid control arrangement (not shown) via neck portions 88*a* and 89*a* and fluid passages 88*b* and 89*b* in the body 82.

Figure 10:
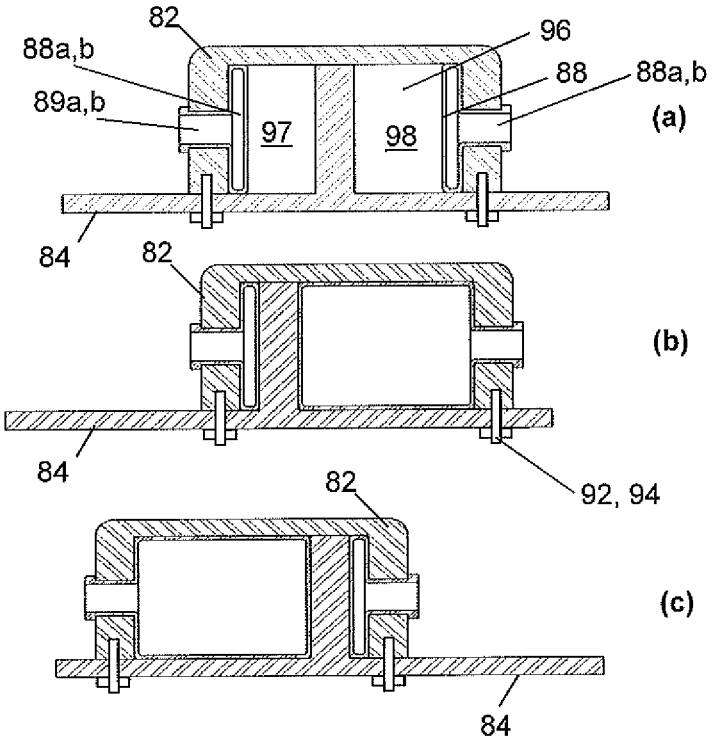
FIG. 10 shows a cross sectional view through the actuator of FIG. 9, showing a drive structure in (a) an intermediate position (b) a first position and (c) a second position, in relation to an actuator body.

The bladders may be inflated and deflated generally as described above, so as to cause the drive structure to move between the first and second configurations shown in FIGS. 10(*b*) and (*c*) by inflating/deflating the bladders 88, 89 generally as described above.

Figure 11:
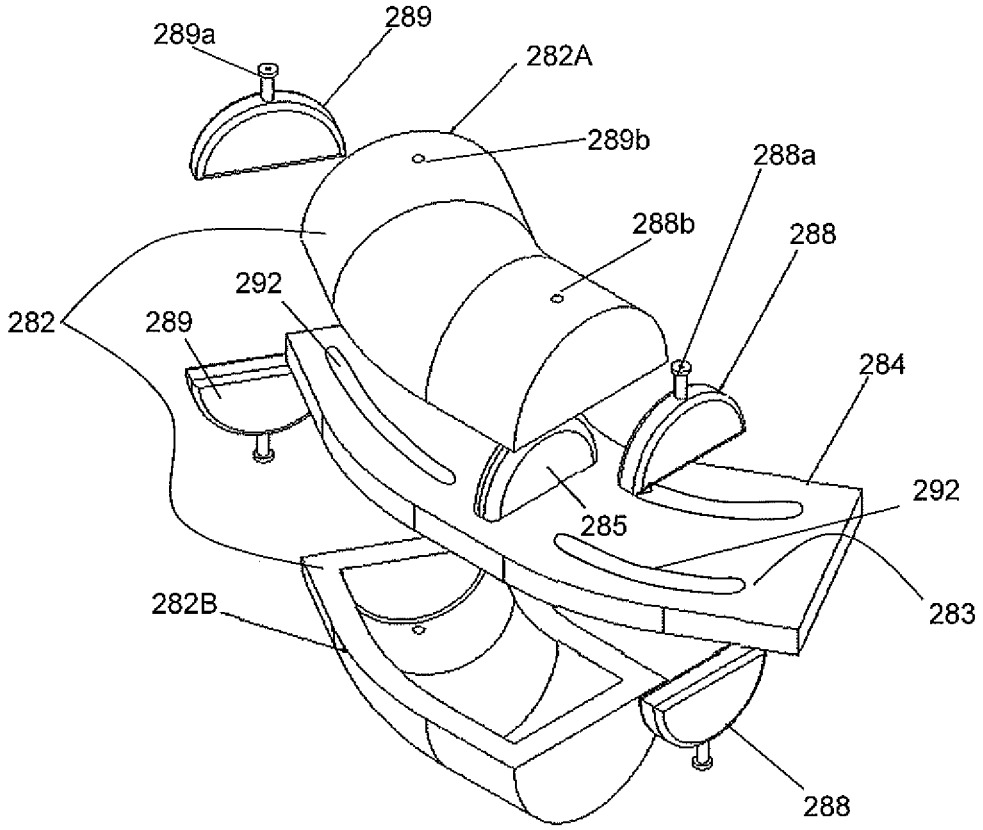
FIG. 11 shows an exploded perspective view of a non-linear fluid actuator.

FIG. 11 shows another embodiment of an actuator 200. The actuator 200 is similar to the actuator 80 and like parts are provided with the same numerals, incremented by 200.

The actuator 200 includes an actuator body 282 formed from two actuator body portions 282A and 282B. Each body portion has an open cavity and so once secured together against opposite sides of the drive plate 283, the body portions and the drive plate together define two internal chambers, one on each side of the drive plate.

A piston member 285 extends from each side of the drive plate into the respective chambers. Thus, the actuator 200 includes four piston chambers, each enclosing an inflatable bladder 288, 289. The two actuator body portions 282A and 289B are disposed symmetrically around the drive structure 284 and deliver an even force to the drive structure. In addition, the force applied is additive, and proportional to the sum of the surface areas of the piston members 285 within the internal chambers.

The two body portions 282A and 282B are secured together via threaded bolts passing through the slots 290, which have been omitted from the figure for clarity.

In contrast to the actuator 80 described above, the slots 292 are curved. The actuator body portions 282A and 282B are provided with the same curvature along their length.

Figure 12:
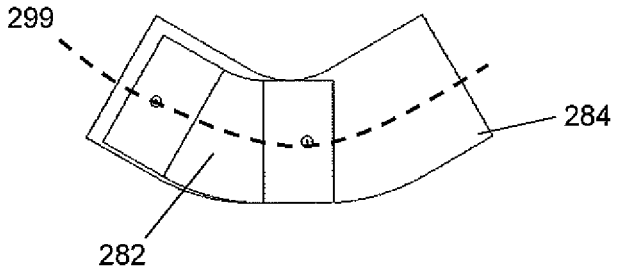
FIG. 12 shows a plan view of the actuator of FIG. 11.

Thus, in use, the slots and the body portions each in part define a non-linear pathway 299 (shown in FIG. 12) along which the drive structure 284 moves in relation to the actuator body 282. In alternative embodiments, the actuator body may be provided with a series of linear and curved segments and the pathway defined by the guide formations (the slots) may comprise a series of straight and curved portions. Movement between the drive structure and the actuator body of such embodiments along a convoluted pathway of this type may be facilitated by the provision of more than one bladder in each piston chamber.

Figure 13:
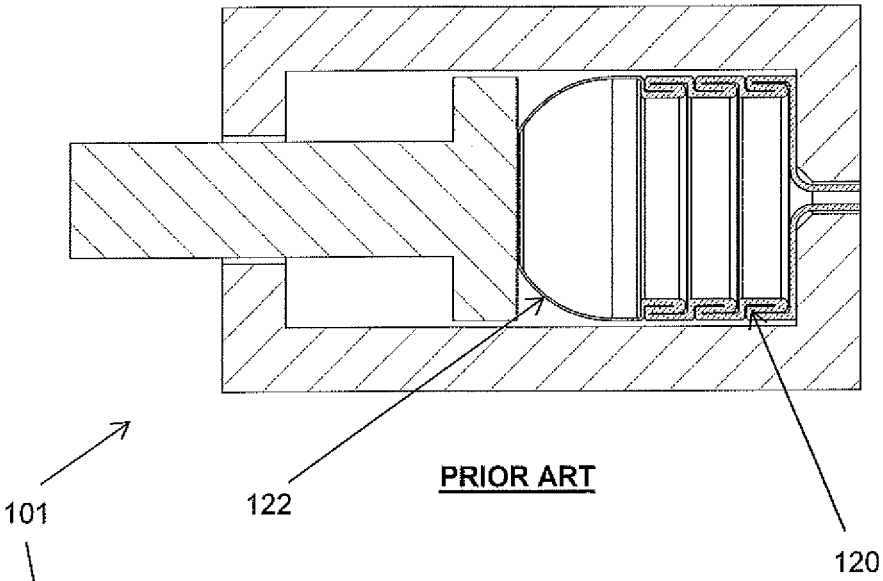
FIG. 13 shows a schematic cross section of a prior art linear fluid actuator.

A known problem in the use of bladders within the piston chambers of hydraulic actuators is folding and pinching of the bladder against the piston chamber walls under the action of a high working fluid pressure. As shown schematically in FIG. 13, in relation to a conventional linear hydraulic actuator 101, folding of the bladder walls (region 120) prevents even inflation of the bladder. Consequently, an adjacent region 122 may be subject to excessive inflation, leading to blistering or even rupture of the bladder. Moreover, bladders constructed from elastomeric materials may be prone to extrusion.

Figure 14:
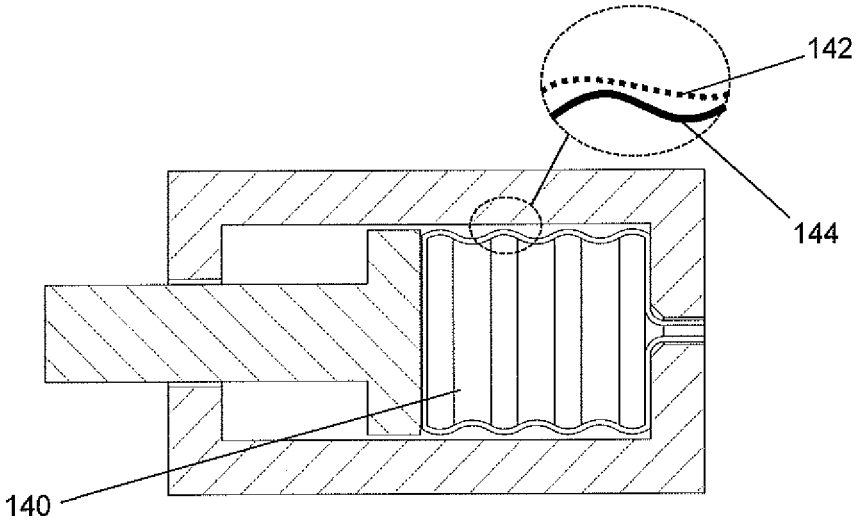
FIG. 14 shows a cross sectional view of a linear fluid actuator having a two-layer inflatable bag in a piston chamber.

FIG. 14 shows an improved bladder 140. The bladder is provided with an outer anti-deformation layer 142 and an inner fluid-tight layer 144. As can be seen in the exploded view, the anti-deformation layer is separate from and so free to move in relation to the inner layer. The anti-deformation layer may optionally be another fluid tight layer, however in the embodiment shown, the anti-deformation layer 142 comprises a Kevlar fabric material. The fabric has an array of apertures which enable fluid within the piston chamber to enter between the layers and provided lubrication. Moreover, the Kevlar layer (or indeed another type of outer anti-deformation layer, such as a metal fabric, or a perforated or fluid-tight outer later) resists against extrusion of the bag. The Kevlar layer is flexible, and resists stretching. Thus, in the event that the bladder does become folded, the anti-deformation layer 142 resists against blistering of the inner fluid-tight layer 144.

Figure 15:
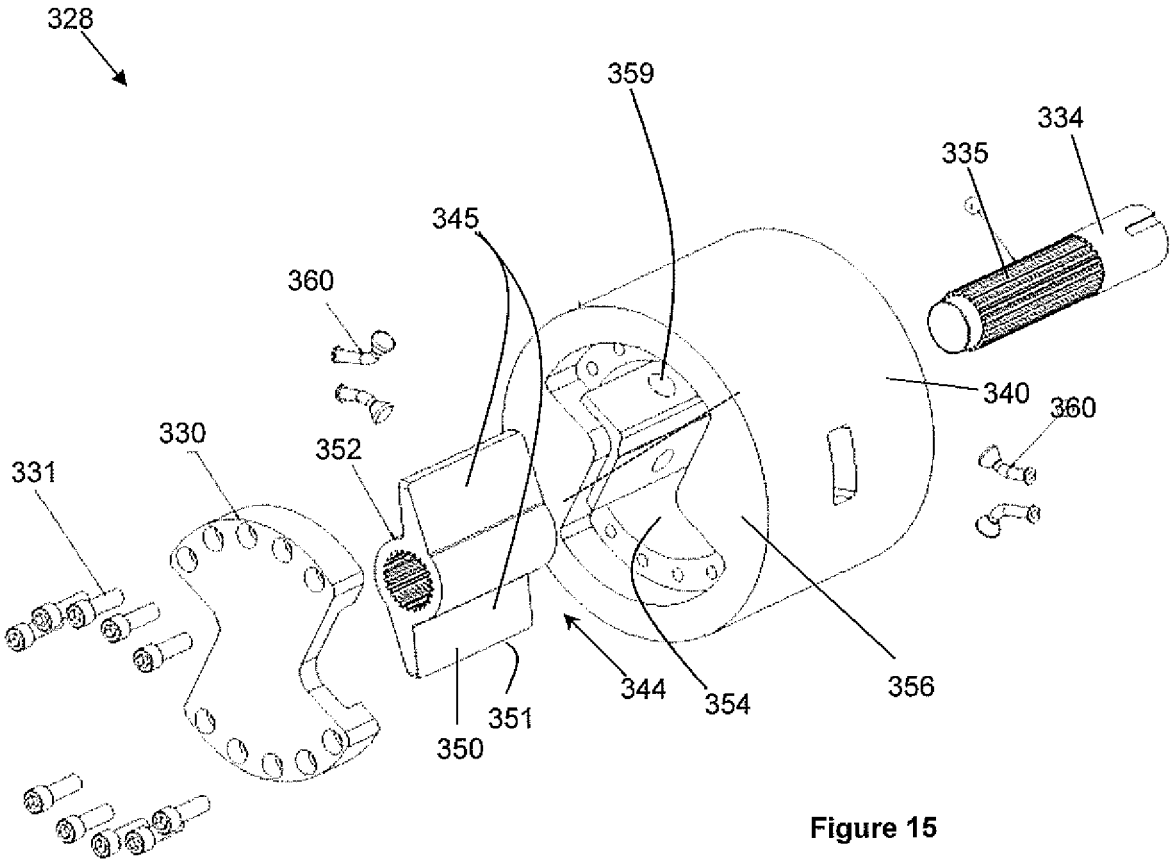
FIG. 15 shows an exploded perspective view of a second embodiment of a rotary fluid actuator.

Another actuator 328 is shown in FIG. 15. Parts in common with the actuator 28 are provided with the same reference numerals, incremented by 300. The actuator 328 includes a cylindrical actuator body 340 having a flat outer face 356. The actuator cover 330 is also flat, so as to lie flush with the outer face 356 when installed.

The drive shaft 334 has a longer spine portion 335 than the drive shaft 34. The vane piston 344 is also thicker. Thus, the faces 345 which in part define respective piston chambers have a greater surface area than the equivalent faces of the vane piston 44. Thus, for a given pressure differential, greater rotational forces are applied by the vane piston 344.

Figure 16:
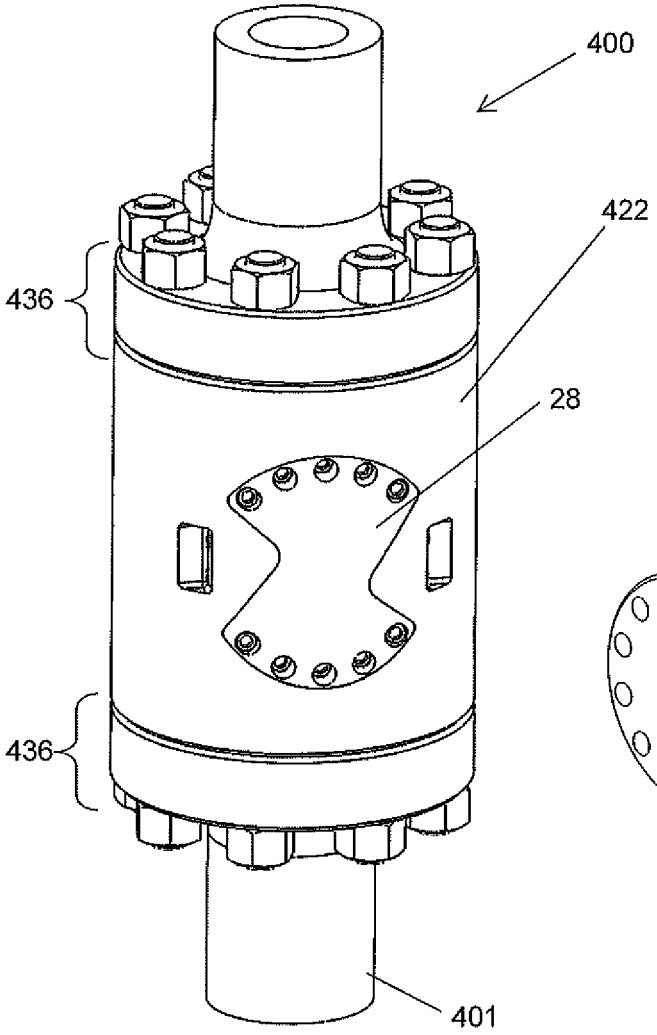
FIG. 16 shows a lubricator comprising a fluid actuator as shown in FIG. 5.
Figure 17:
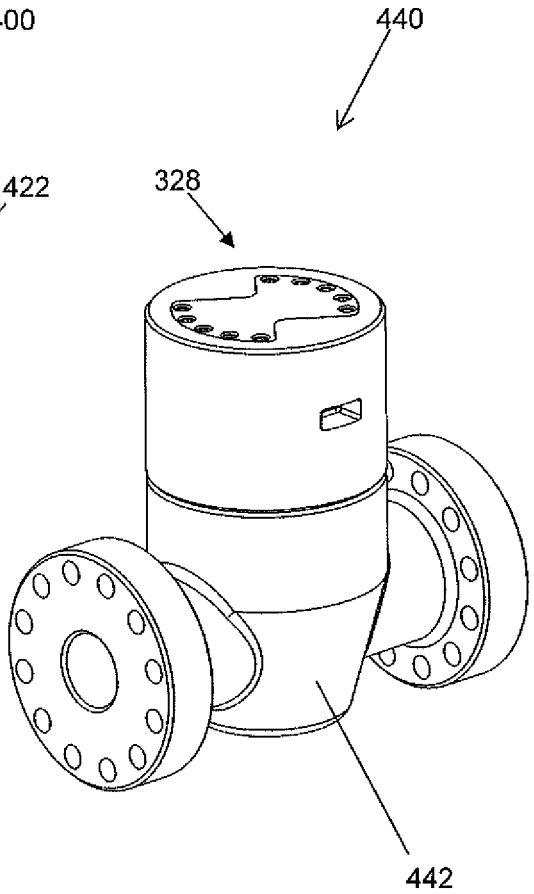
FIG. 17 shows a flow line valve comprising a fluid actuator as shown in FIG. 15.

As mentioned above, the present invention may also be applied to other apparatus. FIG. 16 shows a lubricator valve 400, comprising a cylindrical housing 422 connected via flange connectors 436 to tubular 401. The cylindrical housing 422 defined a flow path having a valve therein (not shown) and a pair of rotary fluid actuators 28 are coupled to the housing and operable to open and close the valve as described above. FIG. 17 shows a flow line valve 440, comprising an actuator 328 coupled to a flow line housing 442.

The invention claimed is:

1. A through riser landing string valve, comprising:

a housing having a housing wall defining a flow path extending in an axial direction through the housing;

an internal valve mounted internally to the housing wall such that the housing wall circumscribes the internal valve;

an external rotary actuator located externally to the housing wall, the external rotary actuator being a fluid rotary actuator operatively connected to the internal valve by a drive shaft, the fluid rotary actuator including a vane piston rotatable around a rotation axis within an internal chamber, wherein a piston chamber is defined by walls of the internal chamber and the vane piston such that a volume of the piston chamber varies with a movement of the vane piston; and a drive arrangement extending laterally through the housing wall and providing a rotatable and non-retractable operative connection between the external rotary actuator and the internal valve, the external rotary actuator operable to operate the internal valve to control fluid flow along the flow path.

2. The through riser landing string valve according to claim 1, wherein the external rotary actuator is isolated from a fluid environment within the housing.

3. The through riser landing string valve according to claim 1, wherein the drive arrangement comprises a drive shaft.

4. The through riser landing string valve according to claim 1, wherein the internal valve is a rotary valve.

5. The through riser landing string valve according to claim 1, wherein the housing comprises a recess, and at least part of the external rotary actuator is accommodated within the recess.

6. The through riser landing string valve according to claim 1, wherein one or more parts of the external rotary actuator are defined by the housing wall.

7. The through riser landing string valve according to claim 1, comprising an actuator outer casing provided separately from the housing wall and which lies flush with an outer surface of the housing wall.

8. The through riser landing string valve according to claim 1, wherein the housing is a cylindrical housing.

9. The through riser landing string valve according to claim 1, wherein the vane piston is moveable responsive to a fluid pressure differential across the vane piston.

10. The through riser landing string valve according to claim 1, wherein more than one internal valve and more than one external rotary actuator are present, and the more than one internal valve is distributed along an axis of the housing, the housing being a cylindrical housing.

11. The through riser landing string valve according to claim 10, wherein each of the more than one internal valve is associated with a corresponding one of the more than one external rotary actuator on diametrically opposite sides of the housing.

12. The through riser landing string valve according to claim 11, wherein said external rotary actuator associated with one internal valve is at least one of axially and circumferentially offset from an actuator associated with an adjacent internal valve.

13. The through riser landing string valve according to claim 12, wherein the external rotary actuator is in a form of circumferentially offset rotary actuators, which in part axially overlap.

14. A subsea test tree, comprising:

a housing defining a flow path and a recess;

a valve mounted in the housing;

a rotary actuator coupled to the housing, at least part of the rotary actuator being accommodated within the recess of the housing, the rotary actuator operable to operate the valve to control a fluid flow along the flow path, the rotary actuator being a fluid rotary actuator operatively connected to the valve by a drive shaft, the fluid rotary actuator including a vane piston rotatable around a rotation axis within an internal chamber, wherein a piston chamber is defined by walls of the internal chamber and the vane piston such that a volume of the piston chamber varies with a movement of the vane piston; and a drive arrangement extending through a wall of the housing to provide a rotatable and non-retractable operative connection between the rotary actuator and the valve.

15. The through riser landing string valve according to claim 1, wherein the internal valve includes a valve member mounted on a saddle member, the drive arrangement being connected to the saddle member.

16. A landing string valve, comprising:

a housing having a housing wall defining a flow path extending in an axial direction through the housing;

an internal valve mounted internally to the housing wall such that the housing wall circumscribes the internal valve;

an external rotary actuator located externally to the housing wall, the external rotary actuator being a fluid rotary actuator operatively connected to the internal valve by a drive shaft, the fluid rotary actuator including a vane piston rotatable around a rotation axis within an internal chamber, wherein a piston chamber is defined by walls of the internal chamber and the vane piston such that a volume of the piston chamber varies with a movement of the vane piston; and a drive arrangement extending laterally through the housing wall and providing a rotatable and non-retractable operative connection between the external rotary actuator and the internal valve, the external rotary actuator operable to operate the internal valve to control fluid flow along the flow path.

* * * * *